US005435079A

United States Patent [19]

Gallegos

[11] Patent Number: 5,435,079

[45] Date of Patent: Jul. 25, 1995

[54] SPRING ATHLETIC SHOE

[76] Inventor: Alvaro Z. Gallegos, Rte. 9-Box 16Q, Santa Fe, N. Mex. 87505

[21] Appl. No.: 169,225

[22] Filed: Dec. 20, 1993

[51] Int. Cl.[6] ..... A43B 21/30; A43B 13/18

[52] U.S. Cl. ..... 36/38; 36/37; 36/27

[58] Field of Search ..... 36/27, 7.8, 37, 38, 36/100, 101, 15

[56] References Cited

U.S. PATENT DOCUMENTS

| | | | |
|---|---|---|---|
| 349,683 | 9/1886 | Biddle . | |
| 458,010 | 1/1891 | Beach | 36/38 |
| 507,490 | 10/1893 | Gambino . | |
| 871,864 | 11/1907 | Feazell et al. | 36/7.8 |
| 884,121 | 2/1907 | Goodwin . | |
| 955,700 | 4/1910 | Schoof . | |
| 968,020 | 8/1910 | Yandori | 36/27 |
| 1,021,751 | 3/1912 | Mathis | 36/38 |
| 1,110,966 | 9/1914 | Severa . | |
| 1,127,456 | 2/1915 | Kurz . | |
| 1,139,417 | 5/1915 | Hering . | |
| 1,206,051 | 11/1916 | Tatum . | |
| 1,380,879 | 6/1921 | Young . | |
| 1,502,087 | 7/1924 | Bunns . | |
| 1,506,315 | 8/1924 | Lywitzki . | |
| 1,587,749 | 6/1926 | Bierly | 36/7.8 |
| 1,670,747 | 5/1928 | Sestito . | |
| 2,104,924 | 1/1938 | Dellea . | |
| 2,159,943 | 5/1939 | Palley | 36/38 |
| 2,183,277 | 12/1939 | Heilhecker | 36/101 |
| 2,299,009 | 10/1942 | Denk . | |
| 2,383,877 | 8/1945 | Miller | 36/38 |
| 2,441,039 | 5/1948 | Smith et al. . | |
| 2,454,951 | 11/1948 | Smith . | |
| 2,508,318 | 1/1949 | Wallach . | |
| 2,668,374 | 2/1954 | Seigle . | |
| 2,669,038 | 2/1954 | Werth . | |
| 2,760,280 | 8/1956 | Carlin . | |
| 2,836,907 | 6/1958 | Windle | 36/38 |
| 3,538,628 | 11/1970 | Einstein, Jr. | 36/100 |
| 3,886,674 | 6/1975 | Pavia | 36/38 |
| 3,996,677 | 12/1976 | Reina | 36/7.8 |
| 4,267,648 | 5/1981 | Weisz . | |
| 4,296,557 | 10/1981 | Pajevic . | |
| 4,317,294 | 3/1982 | Goodyear | 36/100 |
| 4,457,084 | 7/1984 | Horibata et al. . | |
| 4,492,046 | 1/1985 | Kosova . | |
| 4,566,206 | 1/1986 | Weber | 36/27 |
| 4,592,153 | 10/1986 | Jacinto . | |
| 4,638,575 | 1/1987 | Illustrato . | |
| 4,715,130 | 12/1987 | Scatena . | |
| 4,765,412 | 8/1988 | Colonel et al. . | |
| 4,771,554 | 9/1988 | Hannemann . | |
| 5,282,325 | 2/1994 | Beyl | 36/27 |

FOREIGN PATENT DOCUMENTS

| | | | |
|---|---|---|---|
| 633409 | 2/1962 | Italy | 36/38 |
| 20967 | of 1896 | United Kingdom | 36/38 |
| 2111823 | 7/1983 | United Kingdom | 36/38 |

OTHER PUBLICATIONS

Lee, Sharon, "Marco Scatena Puts Spring in Athlon Wearers' Control," Shoe Trade Magazine, p. 20 (date unknown).

"A Spring In," Horseman's Quarterly, pp. 14–16. (author and date unknown).

Burfoot, "High Energy", *Runner's World, pp.38–43, Nov. 1988.*

*Primary Examiner*—Steven N. Meyers

*Attorney, Agent, or Firm*—Oliff & Berridge

[57] ABSTRACT

An athletic shoe includes a spring interposed in its sole providing superior shock absorbance and energy return. The coil spring increases in diameter and is fixed between two spacers, wherein the spacer adjacent the largest diameter end of the spring delimits a space therein. During compression, the smaller end of the spring passes through the larger end and into the space defined by the spacer. The structure maximizes energy return and prevents bottoming out during compression. In an alternate construction, the sole having the spring is removable from the shoe portion such that the shoe portion can be fixed to a plurality of soles. The arrangement can be further revised to accommodate a hoofed foot of an animal. The spring can also be concealed in a hollow heel member of a dress shoe.

14 Claims, 4 Drawing Sheets

SPRING ATHLETIC SHOE

BACKGROUND OF THE INVENTION

The present invention relates to an athletic shoe providing superior support and high energy return, and more particularly, to an athletic shoe having a spring disposed in the heel that is prevented from bottoming out during compression.

There have been disclosed various athletic shoes incorporating a resilient member to provide for shock absorption and energy return. For example, U.S. Pat. No. 4,492,046 to Kosova describes a running shoe having a longitudinal slot in the sole extending from its back edge into the arch region and dividing the shoe sole into upper and lower segments. A spring wire in the slot decreases the velocity of the heel impact, and as the runner's weight shifts forward onto the ball and toes of the foot, the spring wire launches the runner into a comfortable stride.

U.S. Pat. No. 4,566,206 to Weber describes a shoe heel spring support wherein an undamped spring having multi-spring rates is provided in the heel support portion of a shoe for resiliently compressing under heel pressure against the ground and returning a substantial portion of the energy to the wearer's foot. The spring is formed of upper and lower leaflike legs that are integrally joined together at an acute angle whose apex is directed forwardly relative to the shoe. The V shaped spring first tends to compress together to a point where the intermediate leg contacts one of the outer legs, and at that point, increases the spring resistance so that the spring has two different spring rates. Thus, the reference attempts to receive and thereafter discharge the undamped energy put into the spring by the pressure of the wearer's heel against the ground.

U.S. Pat. No. 4,592,153 to Jacinto provides a heel construction for an athletic shoe capable of providing an optimal response for an individual wearing the shoe. The construction is adaptable to being permanently or detachably fixed to a shoe having an upper section and a detachably fixed to a shoe having an upper section and a sole section. The heel construction includes a generally Z-shaped resilient plate having an upper arm extending toward the toe area and a lower arm extending toward the periphery of the heel area of a shoe to which the construction is fixed.

Previous developments and designs, such as those referred to above, as well as other developments and designs of shoe sole constructions still exhibit various drawbacks or disadvantages of one type or another. For example, among the disadvantages such designs exhibit are high manufacturing cost, a limited degree of comfort, complex physical constructions, and in most instances, no optimal response. Furthermore, previous devices that utilize springs for shock absorption and energy return lack any structure to prevent the spring from bottoming out during compression.

SUMMARY OF THE INVENTION

Accordingly, it is an object of the present invention to provide a shoe construction incorporating a spring for shock absorption and energy return that overcomes the disadvantages of the prior art. In particular, it is an object of the present invention to provide a stable and inexpensive athletic shoe incorporating a spring for shock absorption and energy return that is prevented from bottoming out during compression.

These and other objects are achieved by providing a shoe including a foot support member and a shoe sole, wherein the shoe sole includes a first portion having an inner side and a second portion having an inner'surface and an outer surface, and a spring mount securing a spring between the inner side and the inner surface. The spring mount includes a device for preventing the spring from bottoming out during compression.

The spring may be a coil spring having a first end and a second end, wherein the first end has a smaller diameter than the second end such that the first end fits inside of the second end. The spring mount may include a first spring support member supporting the first end spaced from the inner side, and a second spring support member supporting the second end. The first end is extendible through the second end and into a space delimited by the second spring support member. The first spring support member and the second spring support member constitute the device for preventing the spring from bottoming out during compression.

A rigid support plate can be disposed between the inner side and the first spring support member. The shoe may further include structure for removably securing the sole, including at least one first connecting member fixed to an outer side of the first portion, wherein the foot support member includes a corresponding at least one second connecting member, and wherein the at least one first connecting member is removably engagable with the at least one second connecting member. In addition, the at least one connecting member may include at least one wedge receiving aperture, wherein the at least one second connecting member includes at least one wedge.

In another aspect of the invention, there is provided a shoe including a foot support member fixed to a bifurcated shoe sole, wherein the shoe sole includes a first portion having an inner side and a second portion having an inner surface and an outer surface, a rigid support plate fixed to the inner side, and a spring mount fixed to the rigid support plate and the inner surface. The spring mount secures a spring between the rigid support plate and the inner surface and includes a device for preventing the spring from bottoming out during compression.

In yet another aspect of the invention, there is provided a shoe sole including an impact surface made of a first material and having a first side and a second side, a support member, a ring-shaped spacer fixed to the support member, and a spring fixed at a first end to the second side of the impact surface and at a second end to the spacer. The first end of the spring is extendible through the second end of the spring into a space delimited by the ring-shaped spacer. The first material may be one of ethyl vinyl acetate and polyurethane. The support member may be shaped to receive a hoofed foot of an animal.

In still another aspect of the invention, the shoe includes structure for releasably attaching a heel to the foot support portion, wherein the heel includes a hollow support base releasably attachable to the structure on the foot support portion and a ground engaging member telescopingly engaged in the hollow support base and movable between a protruded position and a retracted position. The ground engaging member is urged toward the protruded position by a spring interposed between the hollow support base and the ground engaging member.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

Although the heel construction of this invention may be used on any of a wide variety of footwear, it is particularly useful when employed on footwear utilized in the area of sports, and especially in the area of running or jogging. The shoe sole construction of this invention is accordingly described with respect to a shoe used for running or jogging. However, it is not meant to be limited thereto and may also be used on any of a wide variety of footwear.

Figure 1:
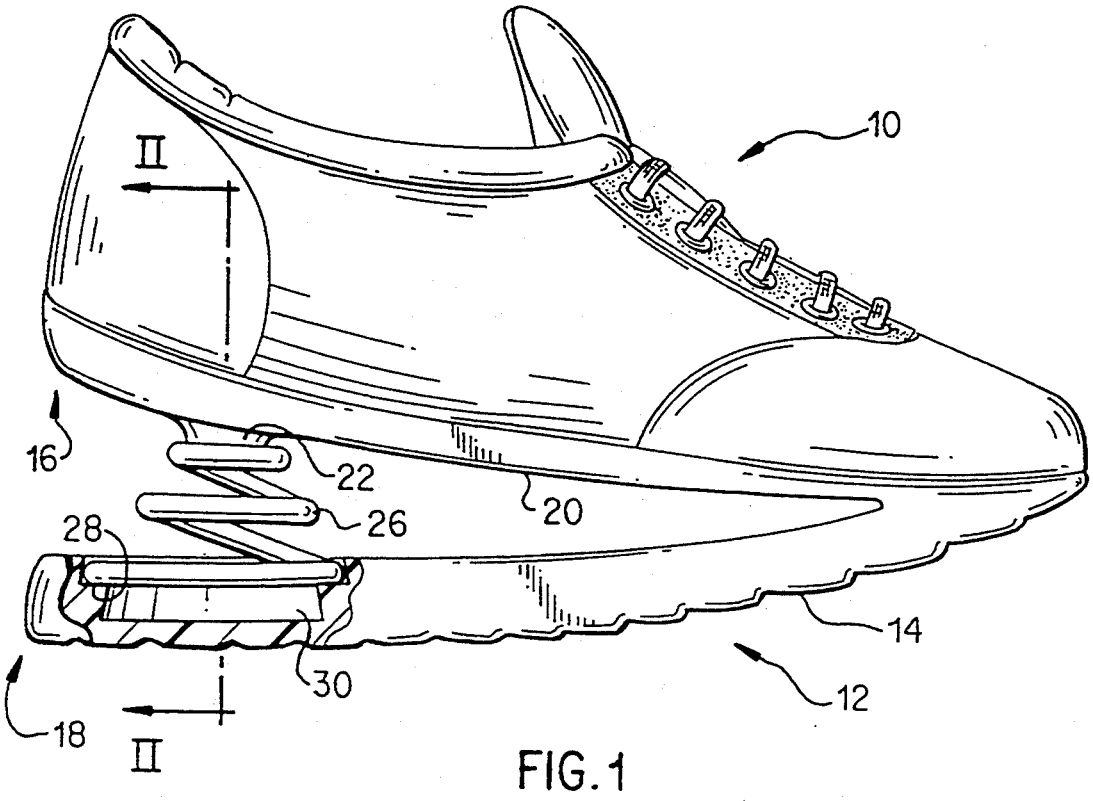
FIG. 1 illustrates an athletic shoe incorporating a spring in an embodiment of the present invention.
Figure 2:
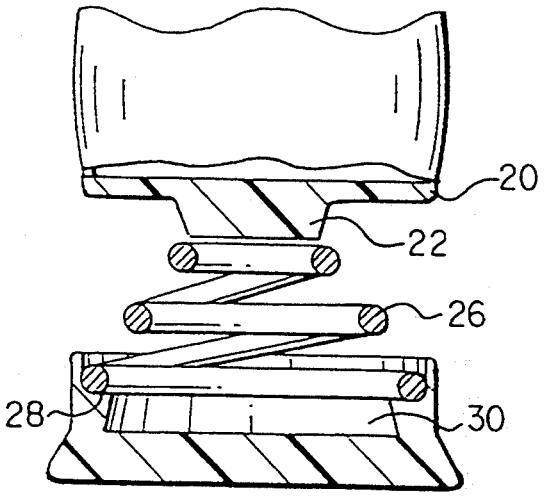
FIG. 2 is a view taken along line II—II in FIG. 1.
Figure 3:
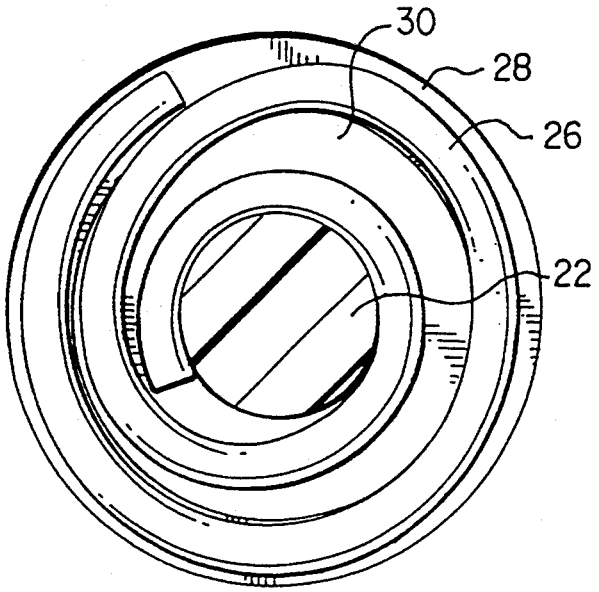
FIG. 3 is a plan view of the spring system of the present invention.

FIGS. 1–3 illustrate the energy return and shock absorption system of the present invention. Referring to FIGS. 1–3, the shoe includes a foot support portion 10 and a sole 12. A ground impacting surface 14 of sole 12 is formed of any suitable durable material such as ethyl vinyl acetate (EVA) or polyurethane. Sole 12 is bifurcated at a central location into two portions 16, 18. A rigid support plate 20 is fixed to portion 16 and serves to provide a rigid support member for the user. An upper spacer 22 is integral with plate 20. Plate 20 and upper spacer 22 are fixed to portion 16 by any suitable means, such as glue and are preferably formed of a durable plastics material such as lexan or an equivalent thereof.

A coil spring 26 is fixedly attached to upper spacer 22 such that its upper end is spaced from support plate 20 and portion 16. In a preferred embodiment, spring 26 increases in diameter from top to bottom such that the end fixed to upper spacer 22 can fit inside of its lower end.

Lower portion 18 of sole 12 includes a stepped hollowed portion defining a spring support shelf 28 that supports the lower end of spring 26, which is fixed to spring support shelf 28 in a manner similar to that as to upper spacer 22. The stepped hollowed portion further defines a space 30 beneath spring support shelf 28. During compression, upper spacer 22 causes the top end of spring 26 to be driven through its lower end and into space 30. As a result, bottoming out of spring 26 is prevented.

Figure 4:
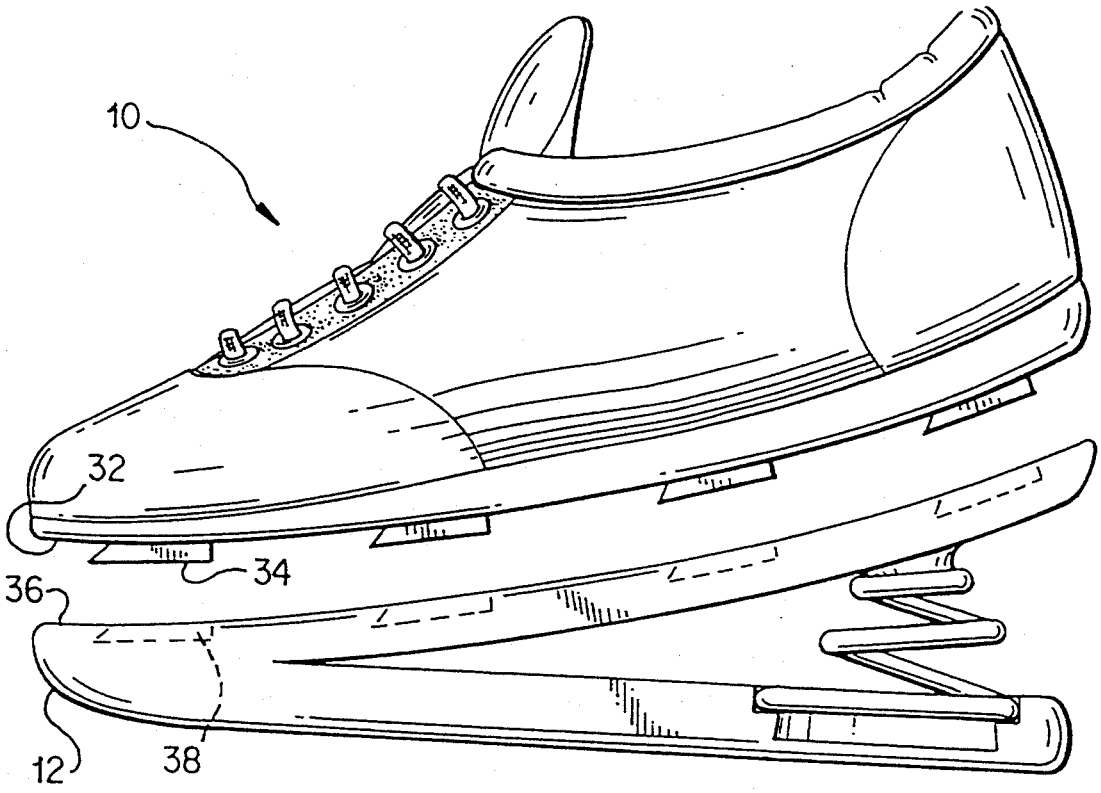
FIG. 4 is a side view illustrating another embodiment incorporating the spring system of the present invention.

In an alternative embodiment, referring to FIG. 4, sole 12 is detachably fixable to shoe 10 via a plurality of connecting members. In a preferred arrangement, a bottom surface 32 of shoe 10 has integral therewith a plurality of wedges 34. An inner surface 36 of sole 12 includes a corresponding plurality of wedge receiving apertures 38 for receiving wedges 34. Wedges 34 and corresponding wedge receiving apertures 38 are formed of a frustoconical shape, providing secure attachment of sole 12 to shoe 10. Wedges 34 are preferably molded with surface 32 and are formed of an unbreakable plastics material such as lexan or an equivalent thereof. In this respect, shoe 10 can be adapted to accommodate various different soles that include wedge receiving members 38, and, accordingly, the spring system of the present invention can be replaced with a normal sole.

Figure 4A:
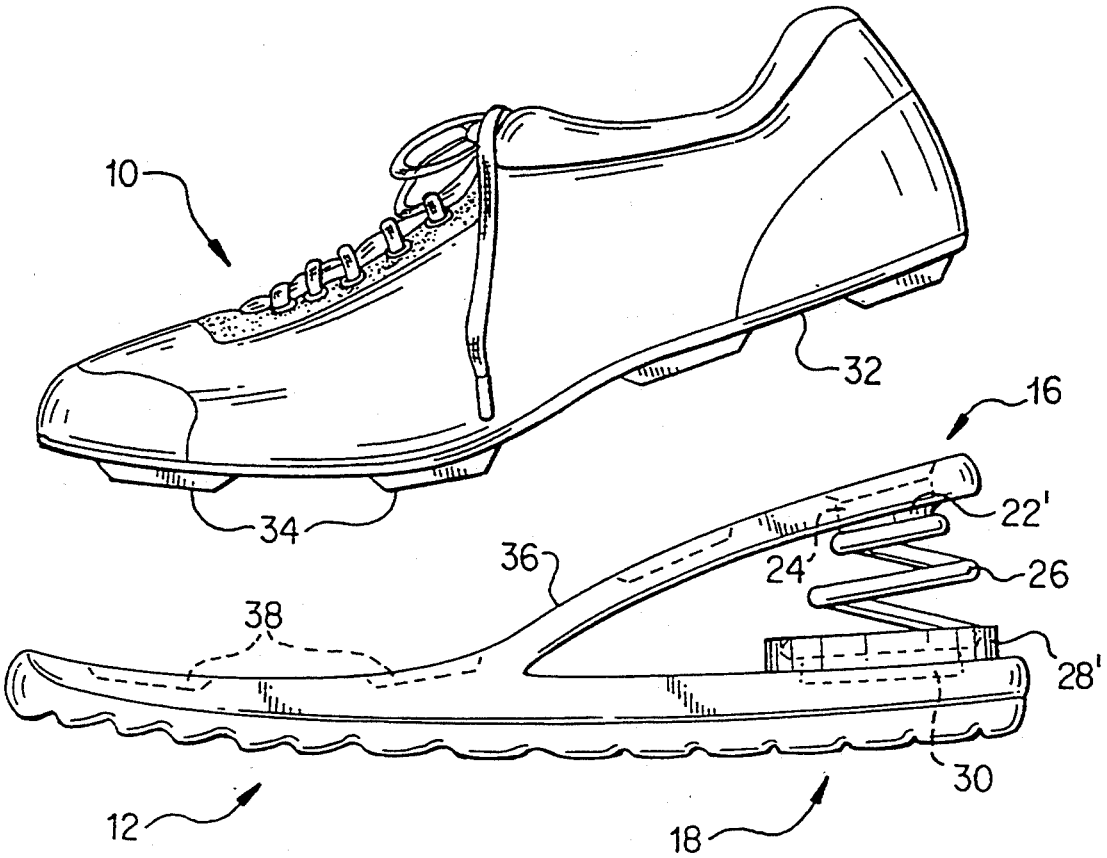
FIG. 4A illustrates an alternative embodiment of the present invention.

In either the FIG. 1 or FIG. 4 embodiment, referring to FIG. 4A, spacer 22' may be formed of a softer material such as polyurethane or EVA. In addition, upper spacer 22' may be fixed to support plate 20 via any suitable means such as glue or integral with upper portion 16, extending through a hole 24 in plate 20. With continued reference to FIG. 4A, spring support shelf 28 may be in the form of a ring shaped spacer 28' fixed to lower portion 18. During compression, upper spacer 22' causes the top end of spring 26 to be driven through its lower end and into space 30 delimited by spacer 28'.

Figure 5:
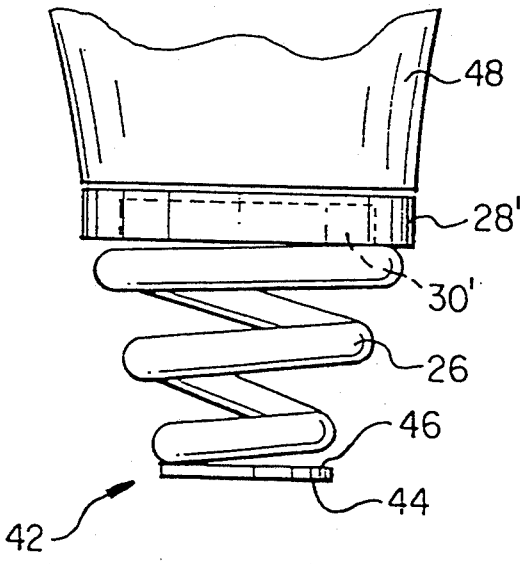
FIG. 5 illustrates yet another embodiment incorporating the spring system of the present invention.

In yet another embodiment, referring to FIG. 5, spring 26 is disposed between a surface impacting member 42 having outer surface 44 and an inner surface 46. Impact member 42 is formed of any suitable durable material such as EVA or polyurethane. Surface 44 is adapted to contact the ground, and surface 46 is fixed to spring 26 in a manner similar to that discussed above. In addition, ring-shaped spacer 28', similar to spring support shelf 28 in previous embodiments, is fixed to an upper end of spring 26. The lower end of spring 26 is compressible through its upper end into space 30' delimited by spacer 28'. Spacer 28' is fixed on an opposite surface to a supporting member 48 for receiving the wearer's foot. Member 48 can be a horseshoe or the like for receiving a hoofed foot of an animal. Space 30' in spacer 28' similarly prevents bottoming out of spring 26 during compression.

Figure 6:
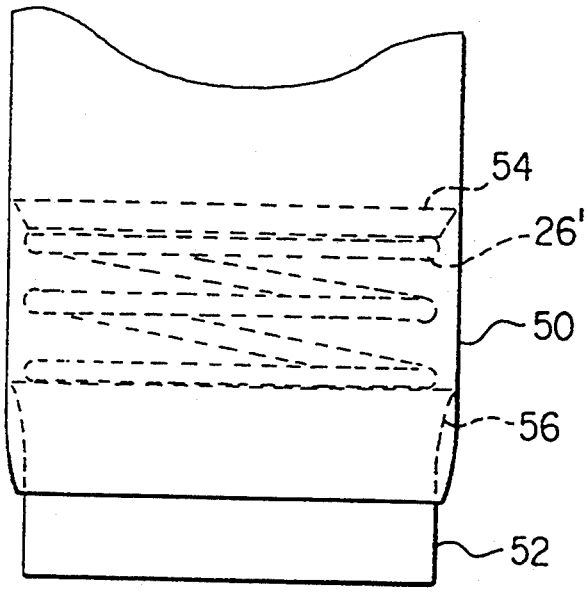
FIGS. 6 and 7 are side views of a concealed spring embodiment of the present invention.
Figure 7:
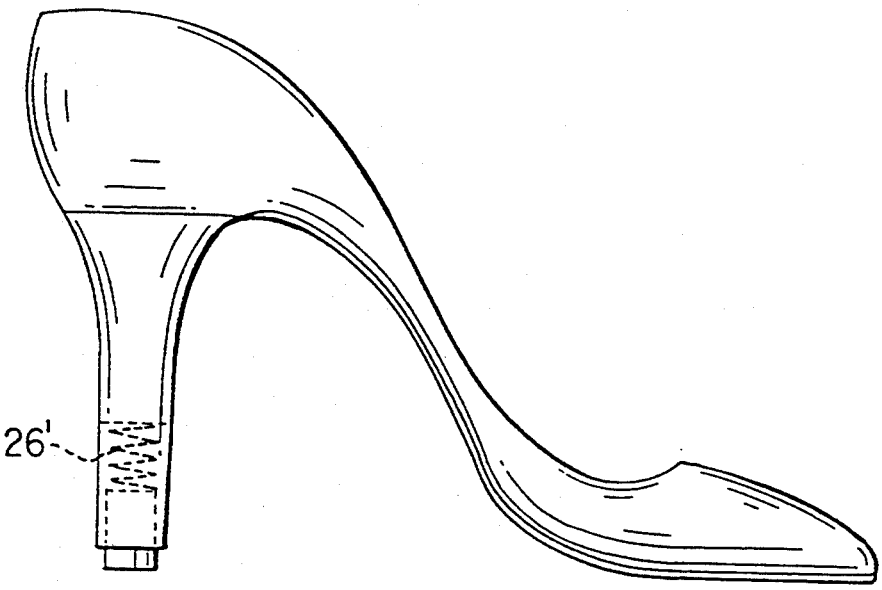

In another embodiment, referring to FIGS. 6 and 7, a spring 26' is interposed between a hollow heel member 50 and a ground engaging member 52. Heel member 50 is removably attachable to foot support portion 10 by any suitable means such as a snap friction fit. Spring 26' engages a shelf 54 in heel member 50 and urges ground engaging member 52 toward a protruded position. Ground engaging member 52 includes a tapered portion 56 for preventing ground engaging member 52 from separating from heel member 50. This arrangement is particularly advantageous in use with a dress shoe, providing superior support and shock absorbance while concealing spring 26'.

The above-described embodiments provide superior shock resistance and energy return while preventing bottoming out of the return spring during compression. The structure is more efficient than the conventional arrangements and is inexpensive to manufacture.

While the embodiments disclosed are preferred, it will be appreciated from this teaching that various alternatives, modifications, variations or improvements therein may be made by those skilled in the art that are within the scope of the invention, which is defined by the following claims.

What is claimed is:

1. A shoe including a foot support member and a shoe sole, said shoe sole comprising:

a first portion having an inner side and a second portion having an inner surface and an outer surface; and a spring mount securing a spring between said inner side and said inner surface, wherein said spring is a coil spring having a first end and a second end, said first end having a smaller diameter than said second end such that said first end fits inside of said second end, and wherein said spring mount comprises a first spring support member supporting one of said first end and said second end of said spring spaced from said inner side, and a second spring support member supporting the other of said first end and said second end of said spring, said first end being extendible through and beyond said second end and into a space delimited by the spring support member supporting said second end.

2. The shoe according to claim 1, wherein said first spring support member is fixed to said inner side and said second spring support member comprises a spring support shelf, hollowed out of said inner surface.

3. The shoe according to claim 2, wherein a rigid support plate is fixed to said inner side, and wherein said first spring support member is integral with said rigid support plate.

4. The shoe according to claim 1, further comprising means for removably securing said sole to said foot support member.

5. The shoe according to claim 4, wherein said first portion further comprises an outer side, and wherein said means for removably securing said sole to said foot support member comprises at least one first connecting member fixed to said outer side, said foot support member comprising a corresponding at least one second connecting member, wherein said at least one first connecting member is removably engagable with said at least one second connecting member.

6. The shoe according to claim 5, wherein said at least one first connecting member comprises at least one wedge receiving aperture, and wherein said at least one second connecting member comprises at least one wedge.

7. A shoe including a foot support member fixed to a bifurcated shoe sole, said shoe sole comprising:

a first portion having an inner side and a second portion having an inner surface and an outer surface;

a rigid support plate fixed to said inner side; and a spring mount fixed to said rigid support plate and said inner surface, said spring mount securing a spring between said rigid support plate and said inner surface and comprising a first spring support member supporting one of a first end and a second end of said spring spaced from said inner side and a second spring support member supporting the other of said first end and said second end of said spring, said first end being extendible through and beyond said second end and into a space delimited by the spring support member supporting said second end.

8. The shoe according to claim 7, wherein said spring is a coil spring, said first end having a smaller diameter than said second end.

9. The shoe according to claim 8, wherein said first spring support member is integral with said support plate and said second spring support member comprises a spring support shelf hollowed out of said inner surface.

10. A shoe sole comprising:

an impact surface made of a first material and having a first side and a second side;

a support member;

a ring-shaped spacer fixed to said support member; and a spring fixed at a first end to said second side of said impact surface and at a second end to said spacer, wherein said first end of said spring is extendible through and beyond said second end of said spring into a space delimited by said ring-shaped spacer.

11. The shoe sole according to claim 10, wherein said first material is one of ethyl vinyl acetate and polyurethane.

12. The shoe sole according to claim 10, wherein said support member is connectable to a hoofed foot of an animal.

13. A shoe including a foot support member and a shoe sole, said shoe sole comprising:

a first portion having an inner side and a second portion having an inner surface and an outer surface; and a spring mount securing a spring between said inner side and said inner surface, said spring having a first end and a second end, wherein said spring mount comprises means for enabling said first end to pass through and beyond said second end.

14. The shoe according to claim 13, wherein said spring mount comprises a first spring support member supporting said first end of said spring and a second spring support member supporting said second end of said spring, wherein said first end is extendible through and beyond said second end and into a space delimited by said second spring support member.

* * * * *